United States Patent [19]

Hunter et al.

[11] Patent Number: 4,575,156

[45] Date of Patent: Mar. 11, 1986

[54] MINING BLOCK AND BIT

[75] Inventors: David L. Hunter, Versailles, Ky.; Leroy E. Den Besten, Valatie, N.Y.

[73] Assignee: Fansteel Inc., North Chicago, Ill. ; by said David L. Hunter

[21] Appl. No.: 589,153

[22] Filed: Mar. 13, 1984

[51] Int. Cl.[4] ..... E21C 35/18

[52] U.S. Cl. ..... 299/92; 299/86; 37/142 R

[58] Field of Search ..... 299/86, 92, 91; 175/354, 413; 279/102, 103; 37/142 R; 403/165; 411/517, 521

[56] References Cited

U.S. PATENT DOCUMENTS

| | | | |
|---|---|---|---|
| 3,397,013 | 8/1968 | Krekeler | 299/92 |
| 3,752,515 | 8/1973 | Oaks et al. | 299/86 |
| 4,201,421 | 5/1980 | Den Besten et al. | 299/92 |
| 4,327,947 | 5/1982 | Bower, Jr. | 299/92 |
| 4,346,934 | 8/1982 | College et al. | 299/92 |
| 4,484,783 | 11/1984 | Emmerich | 299/92 |
| 4,489,986 | 12/1984 | Dziak | 299/92 |

*Primary Examiner*—Stephen J. Novosad
*Assistant Examiner*—Bruce M. Kisliuk
*Attorney, Agent, or Firm*—Barnes, Kisselle, Raisch, Choate, Whittemore & Hulbert

[57] ABSTRACT

A mining block carried by power-operated moving apparatus which is apertured to receive and retain the mounting shanks of elongate mining bits having a sharp wear point extending beyond the block. A block has an open-ended cylindrical recess which ensmalls at the base to a smaller coaxial recess. A conical shoulder at the juncture of the two recesses provides a step for the inner and base end of a mining bit to serve as a wear surface. A retainer on the shank above the base end holds the shank within the cylindrical recess. This eliminates wear at the mouth of the open-ended recess and prolongs the life of the mining block.

1 Claim, 6 Drawing Figures

MINING BLOCK AND BIT

FIELD OF THE INVENTION

The tools used in construction and mining for removing material from walls and ceilings of excavations or in resurfacing pavement in which power-operated moving apparatus carries mounting blocks apertured to receive replaceable pointed mining bits rotatably carried in the blocks.

BACKGROUND OF INVENTION

In the construction and mining industry, large power driven machines carry wheels or chains on which are mounted spaced mining blocks which carry contact tools called mining bits. The blocks have cylindrical recesses to receive the mounting shank ends of a bit, and the cutting or abrading part of the bit projects from the mining block.

It is generally desirable to have these mining bits rotate in the receiving block to equalize the wear around the cutting end. One of the problems in this field has been the wear on the mining blocks which, while replaceable, need to have as long a life as possible to eliminate downtime on the expensive machines. A mining bit can be replaced in minutes if it is broken or worn, but it takes considerably more time to replace a mounting block. Of course, one of the problems in the use of these bits is the abrasive character of the fines and dust which are inherent in the earth or coal cutting operation.

Some years back these mining bits were relatively straight cylindrically shaped bits which were supported at the base ends by a strap or stirrup at the base of the hole in the support block. This type of bit and holder is illustrated in a U.S. Patent to Krekeler, U.S. Pat. No. 3,397,012 (Aug. 13, 1968). A little later a wear collar was utilized in the mounting blocks in which a wear shoulder was formed midway between the ends of the wear collar to engage a shoulder in the block recess. This is illustrated in the U.S. Patent to Kniff, U.S. Pat. No. 3,499,685 (Mar. 10, 1970), now U.S. Pat. No. Re. 29,900. A development from this was a wear shoulder intermediate the ends of the tool shank itself cooperating with a shoulder within the block. This is illustrated in a U.S. Patent to Kniff, U.S. Pat. No. 3,650,565 (Mar. 21, 1972). Another approach utilized a conical shoulder between the cutting end and mounting end of the mining bit which bore on a conical chamfer at the mouth of the block recess. This is illustrated in the U.S. Patent to Engle, U.S. Pat. No. 3,519,309 (July 7, 1970).

Another significant factor in the design of these bit and block combinations is the need for retention of the bit within the block. Whatever design is utilized, there must be a retention ring externally or internally of the block recess.

The present invention contemplates a bit and block design which is compatible with an effective retention system and which removes the bearing surface from the mouth of the block recess to the base of the tool shank. The object of the invention is to provide a construction which will minimize or eliminate the wear at the mouth of the bit opening in the block. With the commonly used structure in use, the thrust is against a conical chamfer at the mouth of the block opening. The pressure from the material being cut drives the bit back into the block which, in turn, distorts the bit seat and increases the wear on the shank hole itself. This causes varying heights of the cutting bits and results in a worn out block.

The present invention is directed to a structure in which the load support is transferred to the base of the block recess and the base of the bit. This area is isolated as much as possible from the abrasive fines resulting from the mining operation. This also removes the pounding and stress at the mouth of the opening and still permits rotation of the bit to equalize wear on the bit itself.

Other objects and features of the invention will be apparent in the following description and claims in which the invention is described together with details to enable persons skilled in the art to practice the invention all in connection with the best mode presently contemplated for the invention.

BRIEF DESCRIPTION OF THE DRAWINGS

DRAWINGS accompany the disclosure and the various views thereof may be briefly described as.

DETAILED DESCRIPTION OF THE INVENTION AND THE MANNER AND PROCESS OF USING IT

Figure 1:
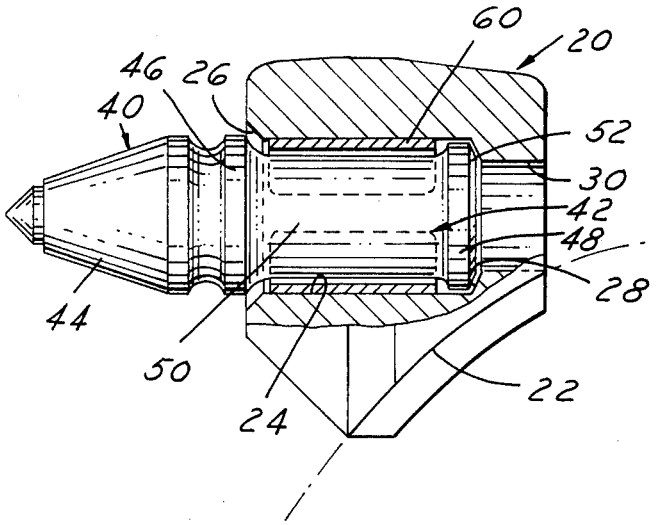
FIG. 1, an assembly view of one embodiment of the invention in cross-section on the axis.
Figure 2:
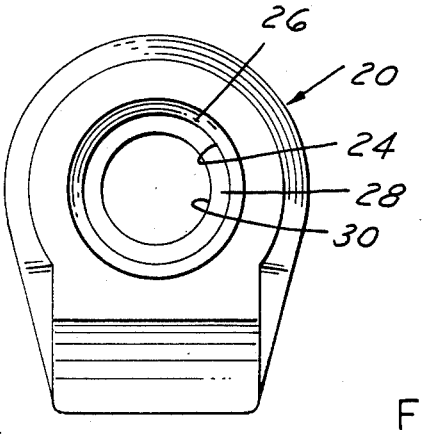
FIG. 2, an end view of the assembly of FIG. 1 from the bit end.
Figure 3:
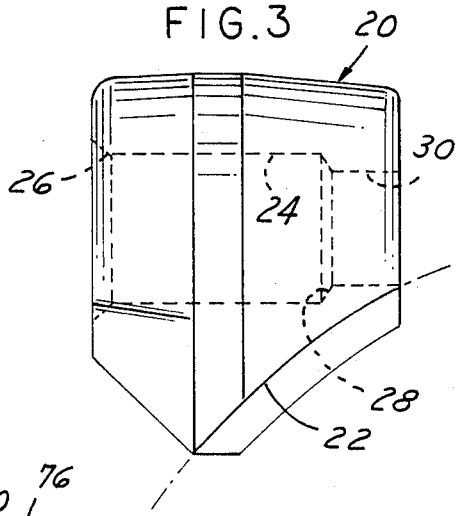
FIG. 3, a side view of the mounting block without the bit.

In FIGS. 1 and 2, a mounting block 20 is illustrated. This block has a curved surface 22 which would mount on a wheel of a power-driven mining machine. The block could also be of the type that would mount on a traveling chain. The block 20 has bore 24 open ended at the left end and terminating at a chamfer 26. The bore 24 ensmalls at a chamfered shoulder 28 to a smaller bore 30 at the base end of the block.

A mining bit 40 has a mounting shank 42 and a projecting operating end 44. Between two lands 46 and 48 is a reduced diameter portion 50. The inner land 48 has an end chamfer 52 which essentially matches the chamfered shoulder 28. The relative dimensions of the block bore and mounting shank are such that the chamfer 52 on the tool contacts the chamfered shoulder so that the land 46 is spaced outwardly of the chamfer 26 on the mounting block.

The retention of the bit in the mounting block may be achieved in different ways known to the industry. In FIG. 1, the retention is achieved by a resilient spring sleeve 60 which has an at-rest diameter larger than the bore 24. The sleeve is dimensioned longitudinally to lie between the lands 46 and 48. Thus, the sleeve is frictionally retained in the bore and this retains the tool. This retainer is described in a U.S. Patent to Den Besten et al, U.S. Pat. No. 4,201,421, issued May 6, 1980.

There is a significant feature in the combination of the above-described sleeve retainer and the tool and block structure. In use, the axial pounding against the tool is absorbed by the inner end of the tool and the shoulder 28. Thus, the open end of the block is not subject to the destruction previously occurring when the outer land was in contact with the chamfer 26. Therefore, the sleeve protects the wall of the bore from abrasion and the tool rotates within the sleeve, which, when worn, can be replaced easily and at low cost.

Figure 4:
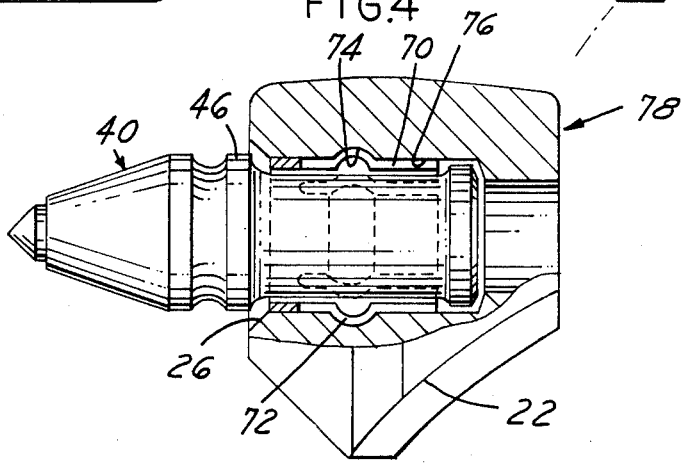
FIG. 4, an embodiment of the invention showing a modified retainer.

Other retention means include a compressible split ring 70 as illustrated in FIG. 4. This ring has raised protuberances 72 which cooperate with a groove 74 in the block bore 76 of block 78. This retainer is illustrated in a U.S. Patent to Kniff, U.S. Pat. No. 3,499,685 issued Mar. 10, 1970.

Figure 5:
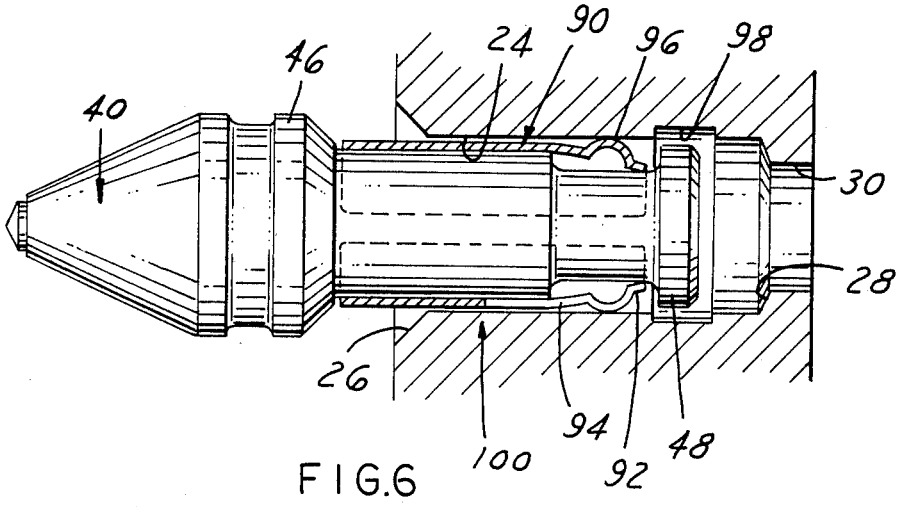
FIG. 5, an embodiment of the invention showing a second modified retainer during the assembly process.
Figure 6:
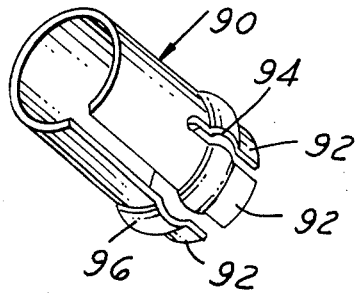
FIG. 6, a perspective view of the retainer illustrated in FIG. 5.

In FIGS. 5 and 6, a third retention means is illustrated in the form of a resilient retention ring 90 having fingers 92 as a result of multiple slots 94 at the inner end of the retainer. An annular bulge 96 on the fingers cooperates with a groove 98 in block 100 to retain the tool in the block. This type of retainer is described in a copending U.S. patent application, Ser. No. 400,733, filed July 22, 1982.

The tool and block combination above described functions in the same manner as previously designed rotating bits. The bit rotates in the block in use, but the severe hammering is absorbed by the base shoulder 28 and the innermost end 48 of the mounting shank of the tool. The mouth of the block is thus not subjected to the abuse of the constant impacting and the block has a much longer life, thus avoiding frequent shut downs for block replacement.

What is claimed is:

1. In a mining tool and mounting block combination in which a mining tool is supported and retained for rotation in a bore of the mounting block, that improvement which comprises:

(a) a support block having an open-ended, two-step bore with an enlarged portion and a reduced portion with a wear shoulder at the bottom end of the enlarged portion of the bore ensmalling the bore to the reduced portion and a mouth at the open outer end of said bore, (b) a mining tool having an extended working portion to extend outside said bore and a mouting shank having an outer end adjacent said working portion and an inner end opposite said working portion to extend into and be retained in said bore, a first annular shoulder land formed between said working portion and said mounting shank at the outer end of said shank having a diameter larger than said bore and a second shoulder land formed adjacent the inner end of said shank, said second shoulder land having a diameter to enter said bore, and said shank having an ensmalled portion of reduced diameter between said first and second shoulder lands, said lands having axially facing surfaces at the ends of said ensmalled portion, (c) a retainer sleeve on the ensmalled portion of said shank extending between and retained axially by the facing surfaces of said first and second shoulder lands to provide a retainer for said shank in said bore, said retainer sleeve serving also as a wear sleeve interposed radially between said ensmalled portion of said shank and the wall of said bore, and engaging the wall of said bore while spaced from the ensmalled portion of said shank, (d) said wear shoulder in said bore being positioned axially relative to the mouth of said bore, and said shoulder lands on said shank being spaced axially, wherein one side of said second shoulder land at the inner end of said shank and bore engages said wear shoulder upon insertion of said shank into said bore and said first shoulder is spaced outwardly of the mouth of said bore.

* * * * *